US008297547B2

(12) United States Patent
Michels et al.

(10) Patent No.: US 8,297,547 B2
(45) Date of Patent: Oct. 30, 2012

(54) ROLLER STORAGE SYSTEM

(75) Inventors: André Michels, Borgentreich-Grosseneder (DE); Heinz Saathoff, Büren (DE)

(73) Assignee: Wincor Nixdorf International GmbH (DE)

( * ) Notice: Subject to any disclaimer, the term of this patent is extended or adjusted under 35 U.S.C. 154(b) by 296 days.

(21) Appl. No.: 12/603,912

(22) Filed: Oct. 22, 2009

(65) Prior Publication Data

US 2011/0017766 A1 Jan. 27, 2011

(30) Foreign Application Priority Data

Jul. 27, 2009 (DE) ..... 10 2009 026 253

(51) Int. Cl.
*B65H 39/14* (2006.01)

(52) U.S. Cl. ..... 242/528; 271/3.01; 271/216

(58) Field of Classification Search ..... 242/528; 271/3.01, 216
See application file for complete search history.

(56) References Cited

U.S. PATENT DOCUMENTS

| | | | | |
|---|---|---|---|---|
| 4,871,125 | A * | 10/1989 | Haueter | 242/528 |
| 5,235,353 | A * | 8/1993 | Hirano et al. | 346/145 |
| 5,732,878 | A | 3/1998 | Schroder et al. | |
| 7,780,111 | B2 * | 8/2010 | Elbel | 242/528 |
| 2002/0060400 | A1 | 5/2002 | Kobayashi et al. | |
| 2002/0162775 | A1 | 11/2002 | Saltsov et al. | |
| 2003/0116400 | A1 | 6/2003 | Saltsov et al. | |
| 2004/0173708 | A1 * | 9/2004 | Neumann et al. | 242/412.3 |
| 2005/0098939 | A1 * | 5/2005 | Lin | 271/109 |
| 2006/0214350 | A1 | 9/2006 | Saltsov et al. | |
| 2010/0133289 | A1 * | 6/2010 | Michels | 221/71 |

FOREIGN PATENT DOCUMENTS

| | | | |
|---|---|---|---|
| DE | 28 14 944 | A1 | 10/1979 |
| DE | 198 58 350 | A1 | 6/2000 |
| DE | 10 2007 022 558 | | 5/2007 |
| DE | 60 2006 000672 | | 4/2009 |
| EP | 0 290 731 | | 3/1988 |
| EP | 0 795 842 | A2 | 9/1997 |
| GB | 2110188 | | 6/1983 |
| GB | 2387167 | | 10/2003 |
| WO | WO 01/54078 | A2 | 7/2001 |
| WO | WO 2007/014803 | A1 | 2/2007 |

* cited by examiner

*Primary Examiner* — Michael Mansen
*Assistant Examiner* — Juan Campos, Jr.
(74) *Attorney, Agent, or Firm* — Harness, Dickey & Pierce, P.L.C.

(57) ABSTRACT

A roller storage system (1) for sheet-type media has at least one film drum (5) driveable by a motor with at least one strip-type film (5) and at least one winding drum (4) with a central drive spindle (8) driveable by a motor, wherein the strip-type film (5) can be wound onto the winding drum (4), where the winding drum (4) is carried floating on the drive spindle (8).

18 Claims, 3 Drawing Sheets

Fig. 3
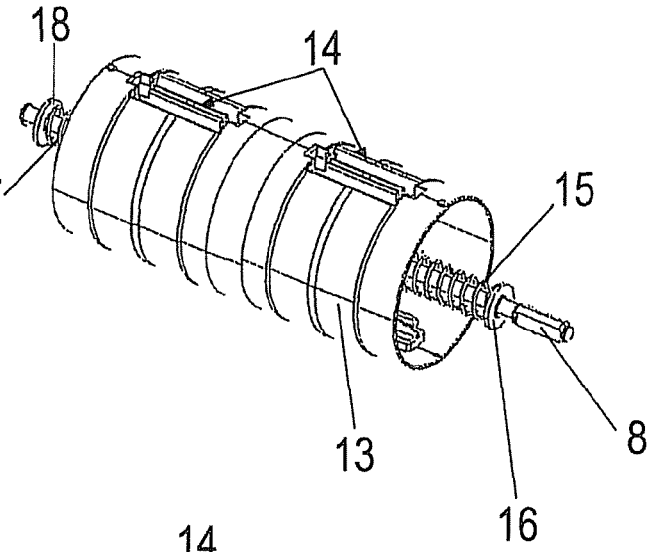
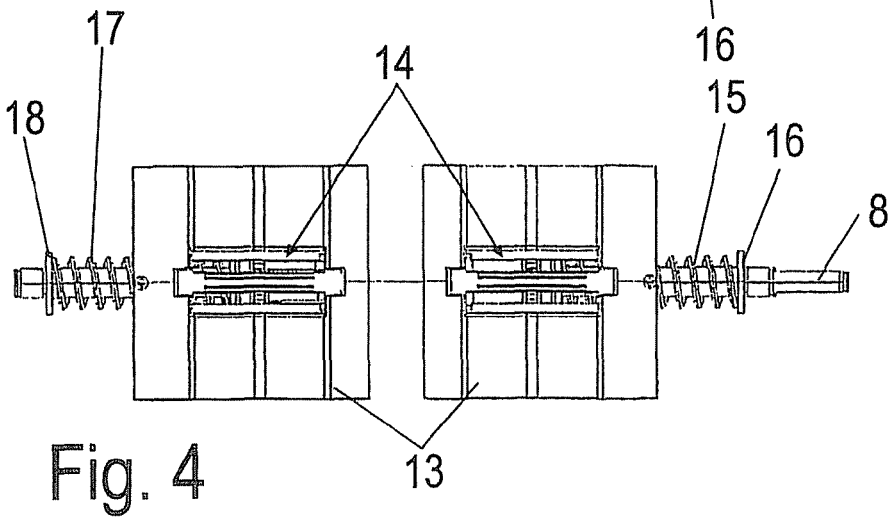
Fig. 4
Fig. 5
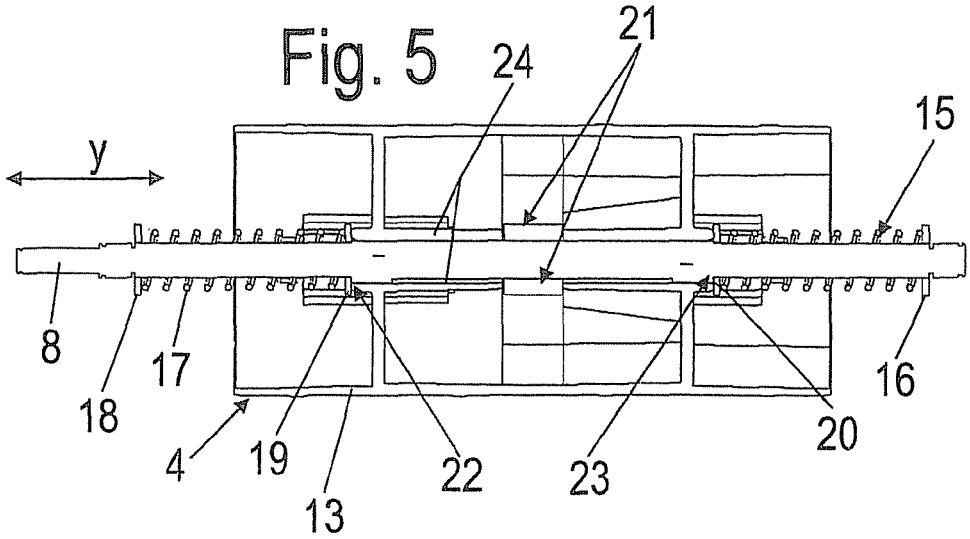

ROLLER STORAGE SYSTEM

BACKGROUND OF THE INVENTION

The present invention relates to a roller storage system for sheet-type media.

Roller storage systems for sheet-type media are used for storing banknotes, for example, in automated teller machines, cash register systems or other money processing systems. The roller storage systems consist of a winding drum and at least one film drum that are mounted to the side walls of a housing, free to rotate about an axis of rotation. To fill the roller storage system, the sheet-type media, in this case the banknotes, are wound in succession onto the winding drum between the winding layers with one or two films. To dispense the sheet-type media, the film is unwound from the winding drum and wound up again on the film drum. As this is done, the sheet-type media stored between the film layers are released again.

The problem with the generic roller storage systems is that as the result of lateral shocks in the direction of the axis of rotation of the winding drum against the roller storage system, or against the side walls of the housing in which the roller storage system is suspended, the note spool can slip on the winding drum, with the consequence that the banknotes can no longer be dispensed smoothly, and/or the sheet-type media can no longer be released smoothly from the winding drum.

SUMMARY OF THE INVENTION

The object of the present invention is, therefore, to prepare a roller storage system for sheet-type media that is insensitive to impacts of this kind in the axial direction of the winding drum.

In accordance with the invention, the roller storage system has a winding drum that is carried floating on a central drive spindle driveable by a motor. As a result of the floating ride, impacts in the direction of this axis of rotation which is configured as a drive spindle can be absorbed, whereby slippage of the note spool resulting from such lateral impacts can be effectively prevented.

In accordance with one variant of the embodiment, the winding drum is coupled to the drive spindle by at least one spring element disposed on the drive spindle. Lateral shocks can be absorbed by the spring element so that the force exerted on the winding drum by the impact is absorbed by the spring element, and a slipping movement of the spool wound onto the winding drum is thereby prevented.

In accordance with a further variant of the embodiment, stops are disposed on the drive spindle fixed in place to position the spring element or elements. The stops are preferably positioned in such a way that, in the relaxed state, the spring element, or elements, keep the winding roller in a centered position on the drive spindle. Using a design of this type, the winding drum can be securely mounted in a housing without the possibility that lateral impacts in the direction of the drive spindle might result in slippage of the spool wound on the winding drum.

In accordance with a further variant of the embodiment, the roller storage system has at least one damping device that acts cooperatively with the winding drum and counteracts an axial motion of said drum. With the use of a damping device of this kind, the energy imparted by the lateral shocks is converted into frictional heat and is thus no longer available to be converted into kinetic energy, meaning acceleration of the film spool or the winding drum respectively.

In a preferred variant of the embodiment, the damping device is configured as a braking element acting cooperatively with the circumferential surface of the drive spindle of the winding drum. The time period for the winding drum to regain its original center position is thereby substantially reduced.

In a further variant of the embodiment, the motor for the film drum and/or the motor for the winding drum in the roller storage system is connected by way of a hysteresis coupling to the drive spindle of the winding drum, or to a drive spindle of the film drum respectively. A tensile force is generated in the film by such a hysteresis coupling, said film being attached in its turn to the winding drum and in this way similarly providing damping of a lateral impact.

BRIEF DESCRIPTION OF THE DRAWINGS

Hereinafter embodiments are explained in greater detail using the appended drawings.

FIG. 3 shows a schematic perspective view of a variant of the embodiment of a winding drum in accordance with the invention, FIG. 4 shows a plan view of the winding drum from FIG. 3, FIG. 5 shows a schematic sectional view through the winding drum shown in FIG. 3 in an intermediate position.

DESCRIPTION OF THE PREFERRED EMBODIMENTS

In the following description of the figures, terms such as top, bottom, left, right, front, rear, etc. refer solely to the representation and position of the roller storage system and other parts selected as examples in the respective figures. These terms are not to be construed as restrictive, that is to say, these references may change as the result of different operating positions, or the mirror-symmetrical layout, or similar.

Figure 1:
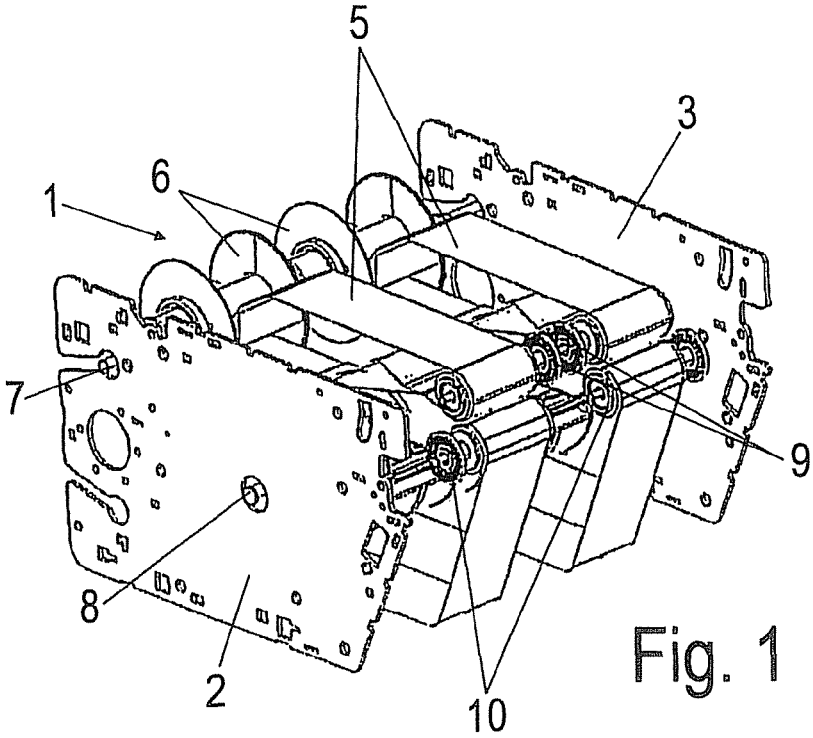
FIG. 1 shows a schematic perspective view of a roller storage system disposed between two side walls of a housing.
Figure 2:
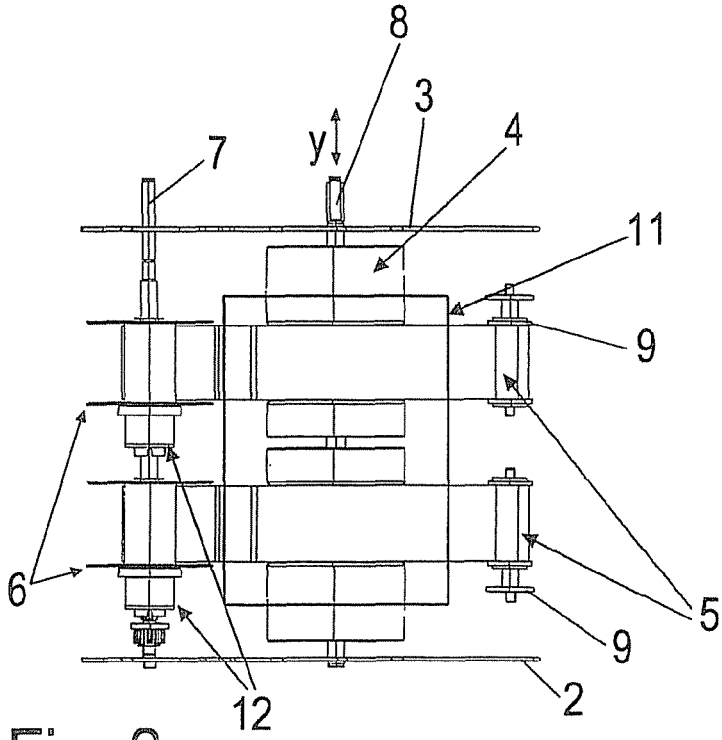
FIG. 2 shows a schematic plan view of the roller storage system from FIG. 1.

In FIG. 1, one variant of the embodiment of a roller storage system for sheet-type media is identified as a whole with the reference numeral 1. As shown in the plan view of the roller storage system from FIG. 1 represented in FIG. 2, roller storage system 1 has a winding drum 4 that is carried on a drive spindle 8. Drive spindle 8 is attached free to rotate to side walls 2 of a housing surrounding roller storage system 1. As can be seen in FIG. 2, on the left adjacent winding drum 4, two film drums 6 driveable by a motor (not shown) are disposed carried on a drive spindle 7, on which a strip-type film 5 can be wound that extends over winding drum 4 perpendicular to drive spindle 7 in a direction y longitudinal to drive spindle 8 of winding drum 4 and is there taken over jockey rollers 9 that are carried parallel to drive spindle 8 of winding drum 4, or to drive spindle 7 of film drum 6 respectively. Films 5 extend from jockey rollers 9 in the direction of winding drum 4. Films 5 are held in locating slots 14 on a circumferential surface 13 of winding drum 4. Locating slots 14 are configured in such a way that they match the width of films 5 and are aligned axially to drive spindle 8 on circumferential surface 13 of winding roller. In the variant of the embodiment shown in FIG. 1, an additional pair of jockey rollers 10 is shown over which a second pair of films is redirected.

As can be clearly seen in FIGS. 3-8, winding drum 4 is carried so that it floats on drive spindle 8. The floating mounting of winding drum 4 is achieved here by at least one spring element 15, 17 disposed on drive spindle 8 by which winding drum 4 is coupled to drive spindle 8. Spring elements 15, 17 are configured here as pressure springs that are passed over drive spindle 8 and terminated in the axial direction by annular discs 16, 18, 19, 20. In the version of the embodiment shown here, a spring element of this kind 15, 17 is disposed on either side of drive spindle 8. Annular discs 16, 18 proximate side walls 2, 3 of the housing are attached to drive spindle 8 fixed in place, while inner annular discs 19, 20 distant from side walls 2, 3 of the housing are disposed to be moveable axially on drive spindle 8, and serve essentially as a pressure surface to apply force in an axial direction y to spring elements 15, 17.

In order to keep winding drum 4 in a centered neutral position, winding drum 4 is provided with a tubular recess 24 in the interior of the circumferential surface through which drive spindle 8 passes, wherein the end faces of this section of tube 24 are configured as axial fixed stops 22, 23 which inner annular discs 19, 20 abut when winding drum 4 is in the centered neutral position. As shown in FIGS. 5-8, the inner tube section 24 is preferably divided into two sections between which a brake element 21 is disposed that bears against the outer surface of drive spindle 8 and has a counteracting, damping effect on any axial displacement of drive spindle 8.

Figure 6:
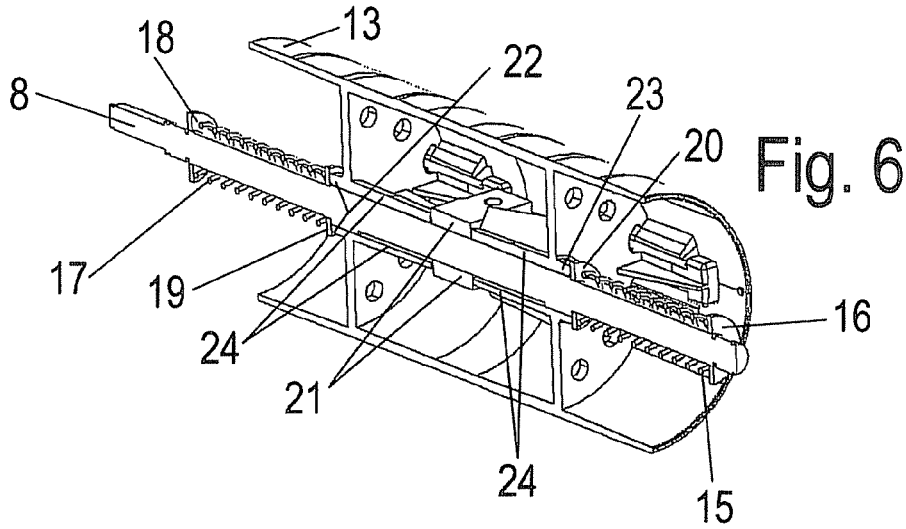
FIG. 6 shows a schematic perspective sectional view of the winding drum from FIG. 5.
Figure 7:
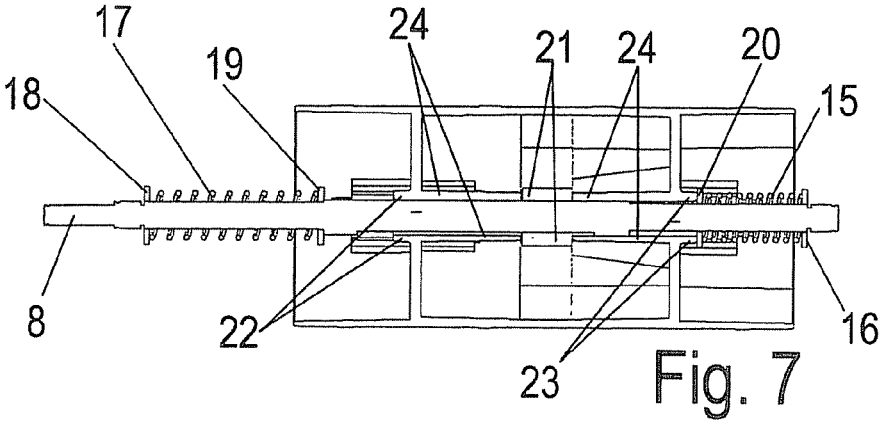
FIG. 7 shows a schematic sectional plan view of the winding drum in a position displaced to the right.
Figure 8:
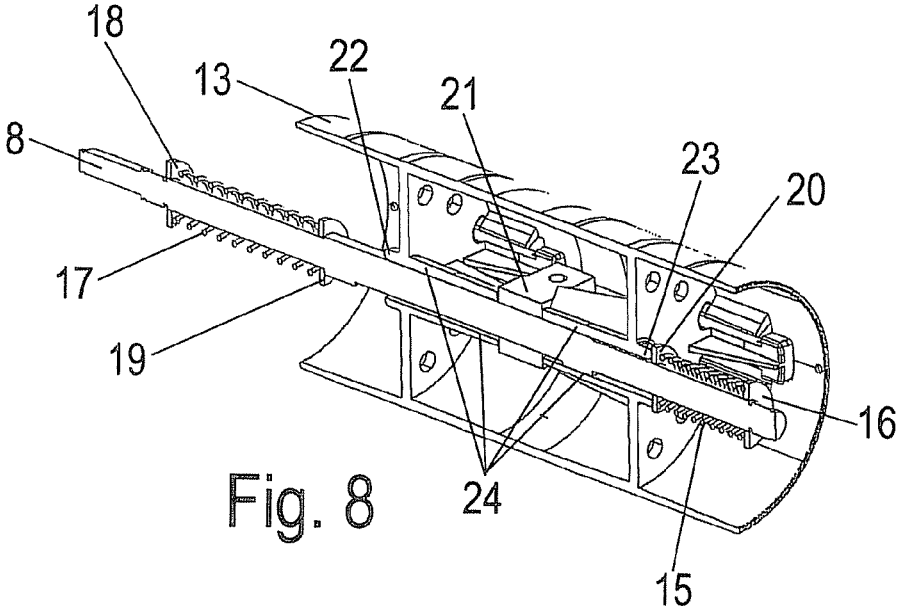
FIG. 8 shows a perspective sectional view of the winding drum displaced to the right from FIG. 7.

In the representations shown in FIGS. 5 and 6, winding drum 4 is in the center neutral position, while in the representations shown in FIGS. 7 and 8, winding drum 4 is in a position displaced to the right that was occasioned by an impact in the axial direction y, in FIGS. 7 and 8 an impact directed to the right. As can be seen in FIGS. 7 and 8, winding drum 4 is pushed to the right, with right pressure spring 15 squeezed together, while left pressure spring 17 is expanded. After the impact has occurred, compressed pressure spring 15 will push winding drum 4 into its initial center position again and in so doing slightly compress second pressure spring 17 in a first spring back action. Then second pressure spring 17 will also push winding drum 4 in the direction of its neutral position again. This process is repeated until the neutral position is regained as the result of frictional losses.

As a result of the disposition of brake element 21 during the displacement of winding drum 4 on drive spindle 8, additional friction is created so that the neutral position is reached more quickly after the deflection resulting from an impact, meaning that winding drum 4 is resting in its neutral position again.

Alternatively, or additionally, as shown in FIG. 4, the motor for film drum 6 and/or the motor for winding drum 4 can be connected through a hysteresis coupling 12 to drive spindle 8 of winding drum 4, or to a drive spindle 7 of film drum 6. Hysteresis coupling 12 generates a tensile force in film 5 that is attached to winding drum 4, as explained earlier above, and thus provides additional, increased friction when winding drum 4 is deflected in an axial direction.

The measure of damping effected by hysteresis coupling 12 and/or braking element 21 is dependent on the geometric ratios of winding drum 4 and the film width as well as on the torque of hysteresis coupling 12. It is important that the total of the damping acting in an axial direction and the filtering force lies as closely as possible below a force that causes the media spool 11, consisting of film 5 and the sheet-type media stored therein, to slip on winding drum 4 in the axial direction so that the shock from an impact in an axial direction is absorbed by spring elements 15, 17 before media spool 11 begins to slip.

What is claimed is:

1. Roller storage system for sheet-type media, comprising:
at least one film drum including at least one strip-type film;
a central drive spindle drivable by a motor;
a first fixed disc and a second fixed disc each integral with the central drive spindle and fixedly mounted near opposite ends of the central drive spindle;
a first movable disc and a second movable disc each integral with the central drive spindle and slidably movable on the central drive spindle along a longitudinal axis thereof, the first movable disc is proximate to the first fixed disc and the second movable disc is proximate to the second fixed disc;
a first spring mounted to the central drive spindle between the first fixed disc and the first movable disc, and a second spring mounted to the central drive spindle between the second fixed disc and the second movable disc; and
at least one winding drum mounted to the central drive spindle between the first movable disc and the second movable disc, where the strip-type film can be wound onto the winding drum, the winding drum is slidably movable along the longitudinal axis of the central drive spindle.

2. The roller storage system of claim 1, wherein one of the first spring and the second spring are configured as pressure springs.

3. The roller storage system of claim 1, wherein axially fixed stops are disposed on the drive spindle to position the first spring and the second spring.

4. The roller storage system of claim 3, wherein the stops are positioned such that the winding drum is held in a centered position on the drive spindle with the first spring and the second spring in a relaxed state.

5. The roller storage system of claim 1, characterized by at least one damping device acting cooperatively with the winding drum and counteracting an axial motion of the winding drum.

6. The roller storage system of claim 5, wherein the at least one damping device is configured as a braking element acting cooperatively with a surface of the central drive spindle.

7. A roller storage system for sheet-type media, comprising:
a first drive spindle drivable by a motor;
a first movable disc and a second movable disc each integral with the first drive spindle, and slidably movable on the first drive spindle along a longitudinal axis thereof;
a winding drum mounted to the first drive spindle between the first movable disc and the second movable disc, the winding drum is slidably movable along the longitudinal axis of the first drive spindle;
a film drum mounted to a second drive spindle; and
a strip-type film extending between the film drum and the winding drum and configured to be wound onto and off of each of the winding drum and the film drum upon rotation of the first drive spindle and the second drive spindle;
wherein movement of the winding drum along the longitudinal axis is dampened through contact with the first movable disc and the second movable disc.

8. The roller storage system of claim 7, further comprising a first fixed disc integral with the first drive spindle and fixedly mounted to the first drive spindle between the first movable disc and a first end of the first drive spindle; and a second fixed disc integral with the first drive spindle and fixedly mounted to the first drive spindle between the second movable disc and a second end of the first drive spindle that is opposite to the first end.

9. The roller storage system of claim 8, further comprising:

a first spring between the first movable disc and the first fixed disc; and a second spring between the second movable disc and the second fixed disc.

10. The roller storage system of claim 9, wherein the first spring is wrapped around the first drive spindle and the second spring is wrapped around the first drive spindle.

11. The roller storage system of claim 9, wherein upon movement of the winding drum along the longitudinal axis, a stop of the winding drum contacts the first movable disc to move the first movable disc toward the first fixed disc and compress the first spring therebetween, the spring subsequently decompresses and returns to a relaxed position to center the winding drum on the first drive spindle.

12. The roller storage system of claim 9, wherein the first spring is spaced apart from the winding drum and the second spring is spaced apart from the winding drum.

13. The roller storage system of claim 7, wherein the winding drum includes a braking element in cooperation with the first drive spindle to restrict movement of the winding drum along the longitudinal axis.

14. The roller storage system of claim 7, wherein the winding drum includes a first stop in cooperation with the first drive spindle and configured to contact the first movable disc; and wherein the winding drum includes a second stop in cooperation with the first drive spindle and configured to contact the second movable disc.

15. A roller storage system for sheet-type media comprising:

a first drive spindle;

a first spring wound onto the first drive spindle proximate to a first end thereof, the first spring is compressible between a first movable disc and a first fixed disc that are both integral with the first drive spindle, the first movable disc is slidably movable on the first drive spindle along a longitudinal axis thereof, the first fixed disc is fixedly mounted to the first drive spindle;

a second spring wound onto the first drive spindle proximate to a second end thereof that is opposite to the first end, the second spring is compressible between a second movable disc and a second fixed disc that are both integral with the first drive spindle, the second movable disc is slidably movable on the first drive spindle along the longitudinal axis thereof, the second fixed disc is fixedly mounted to the first drive spindle;

a winding drum mounted to the first drive spindle between the first movable disc and the second movable disc, the winding drum is spaced apart from each of the first spring and the second spring, a first flange of the winding drum is configured to cooperate with the first movable disc and a second flange of the winding drum is configured to cooperate with the second movable disc;

a film drum mounted to a second drive spindle; and a strip-type film extending between the film drum and the winding drum and configured to be wound onto and off of each of the winding drum and the film drum upon rotation of the first drive spindle and the second drive spindle;

wherein upon movement of the winding drum along the longitudinal axis of the first drive spindle, the first flange of the winding drum contacts the first movable disc to move the first movable disc toward the first fixed disc and compress the first spring therebetween, subsequent decompression of the first spring returns the winding drum to a center position on the longitudinal axis.

16. The roller storage system for sheet-type media of claim 15, wherein the winding drum includes a brake between the first flange and the second flange, the brake includes a first portion in cooperation with a first area of the first drive spindle and a second portion in cooperation with a second area of the first drive spindle, the first portion is opposite to the second portion.

17. The roller storage system for sheet-type media of claim 15, wherein the first spring and the second spring are pressure springs.

18. The roller storage system for sheet-type media of claim 15, wherein the first flange is a stop and the second flange is a stop.

* * * * *